United States Patent [19]

Sugiyama

[11] Patent Number: 4,798,010

[45] Date of Patent: Jan. 17, 1989

[54] MIDSOLE FOR SPORTS SHOES

[75] Inventor: Yasunori Sugiyama, Hyogo, Japan

[73] Assignee: Asics Corporation, Japan

[21] Appl. No.: 180,613

[22] Filed: Apr. 4, 1988

Related U.S. Application Data

[63] Continuation of Ser. No. 913,568, Sep. 29, 1986, abandoned, which is a continuation of Ser. No. 650,287, Sep. 12, 1984, abandoned.

[30] Foreign Application Priority Data

Jan. 17, 1984 [JP] Japan ..... 59-6088

[51] Int. Cl.[4] ..... A43B 13/12; A43B 13/18

[52] U.S. Cl. ..... 36/30 R; 36/31; 36/28

[58] Field of Search ..... 36/25 R, 30 R, 28, 32 R, 36/114, 129, 31, 102, 103, 27; 128/585

[56] References Cited

U.S. PATENT DOCUMENTS

| | | | |
|---|---|---|---|
| 2,124,819 | 7/1938 | Halloran | 36/30 R |
| 3,738,373 | 6/1973 | Glancy | 128/585 |
| 4,043,058 | 8/1977 | Hollister et al. | 36/28 |
| 4,085,527 | 4/1978 | Riggs | 36/32 R |
| 4,237,627 | 12/1980 | Turner | 36/129 |
| 4,302,892 | 12/1981 | Adamik | 36/129 |
| 4,316,332 | 2/1982 | Giese et al. | 36/30 R |
| 4,348,821 | 9/1982 | Daswick | 36/129 |
| 4,364,188 | 12/1982 | Turner et al. | 36/30 R |
| 4,364,189 | 12/1982 | Bates | 36/30 R |
| 4,391,048 | 7/1983 | Lutz | 36/30 R |
| 4,399,620 | 8/1983 | Funck | 36/28 |
| 4,498,251 | 2/1985 | Shin | 36/30 R |
| 4,506,462 | 3/1985 | Cavanagh | 36/31 |
| 4,551,930 | 11/1985 | Graham et al. | 36/30 R |
| 4,562,651 | 1/1986 | Frederick et al. | 36/102 |
| 4,614,046 | 9/1986 | Dassler | 36/30 R |

FOREIGN PATENT DOCUMENTS

| | | | |
|---|---|---|---|
| 3329742 | 7/1984 | Fed. Rep. of Germany | 36/28 |
| 2522482 | 9/1983 | France | 36/28 |

OTHER PUBLICATIONS

Japanese Utility Application 197592/1982, Jul. 12, 1984, "Sole for Sport Shoes", Mizuno.

*Primary Examiner*—Steven N. Meyers
*Attorney, Agent, or Firm*—Lyon & Lyon

[57] ABSTRACT

This invention relates to a midsole for sports shoes, which comprises a hard elastic member and a soft elastic member which has a lower hardness than that of said hard elastic member, one surface of said hard elastic member being joined to one surface of said soft elastic member which is opposite to said one surface of said hard elastic member, said one surface of said hard elastic member having a wavy configuration at the outer area of the heel portion thereof with respect to a longitudinal direction of said midsole said one surface of said soft member having a complementary configuration to said one surface of said hard elastic member at the outer area of the heel portion thereof.

10 Claims, 21 Drawing Sheets

FIG. 9(a)
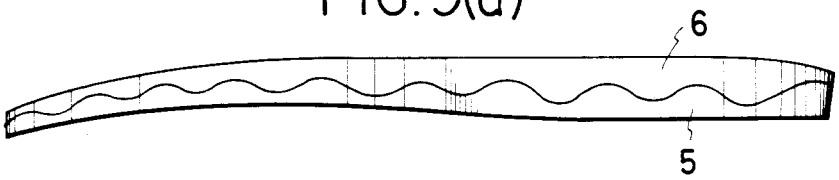
FIG. 9(b)
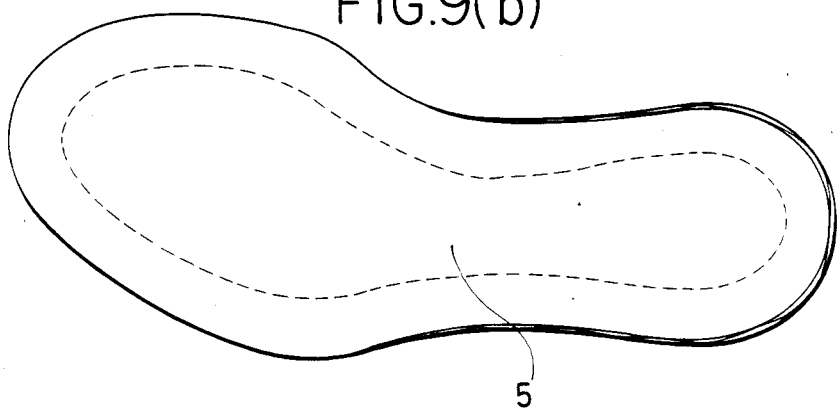
FIG. 9(c)
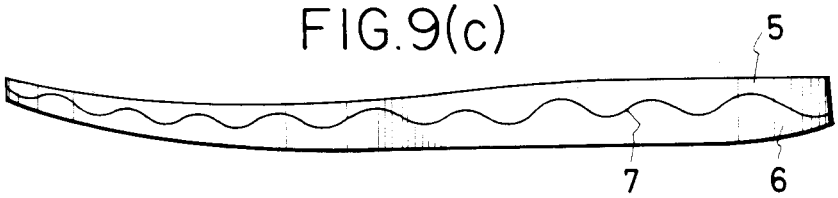
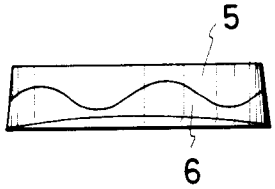
FIG. 9(d)

FIG. 10(a)
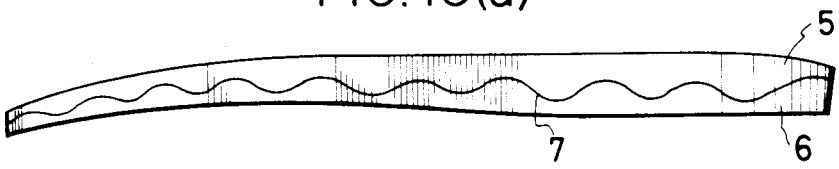
FIG. 10(b)
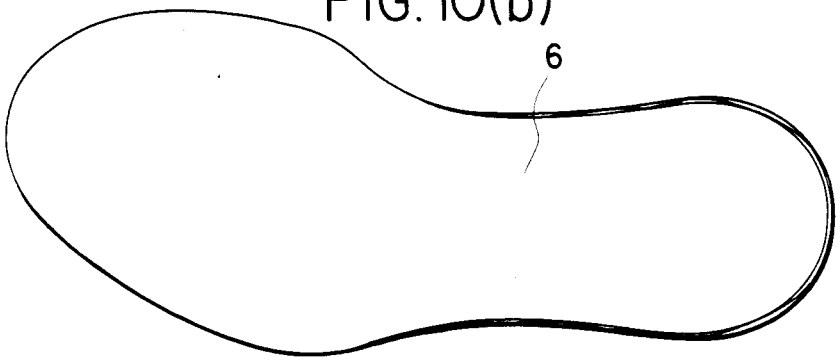
FIG. 10(c)
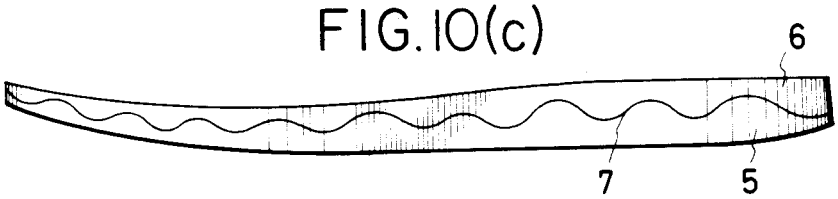
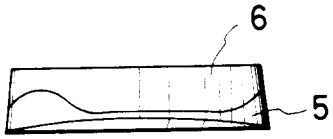
FIG. 10(d)

FIG.11(a)
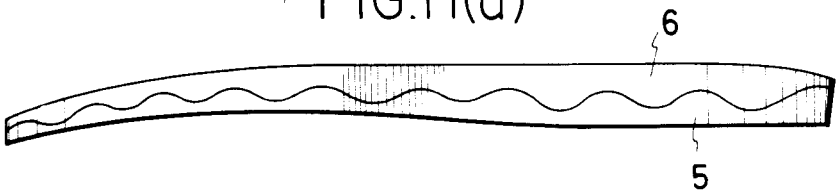
FIG.11(b)
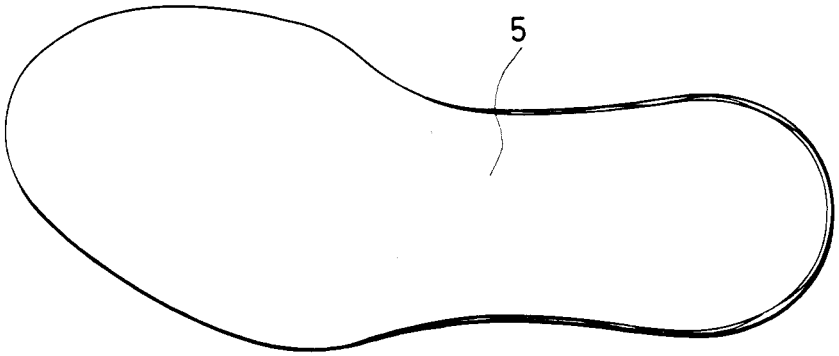
FIG.11(c)
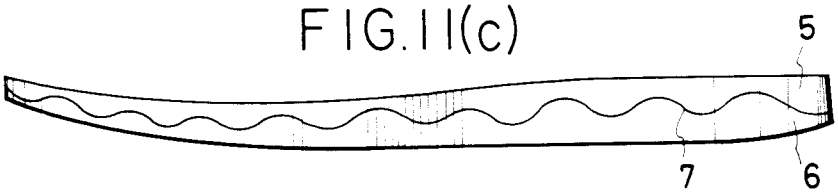
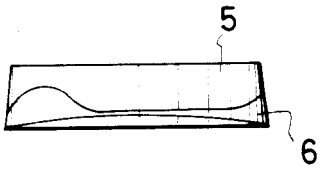
FIG.11(d)

FIG. 12(a)
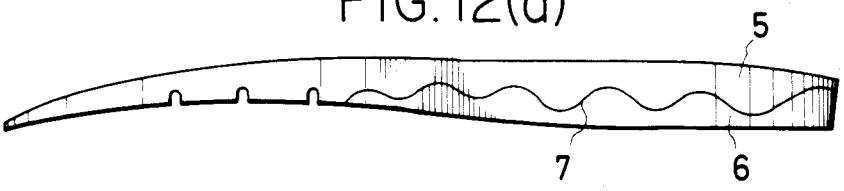
FIG. 12(b)
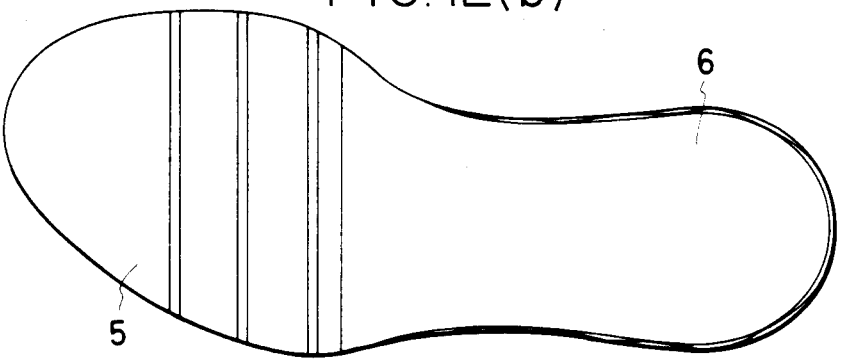
FIG. 12(c)
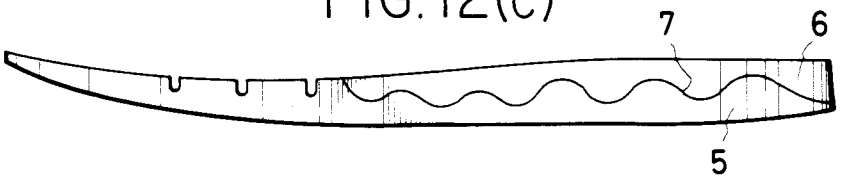
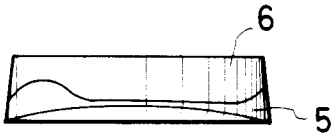
FIG. 12(d)

FIG. 13(a)
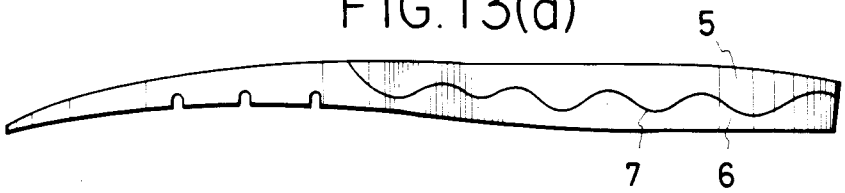
FIG. 13(b)
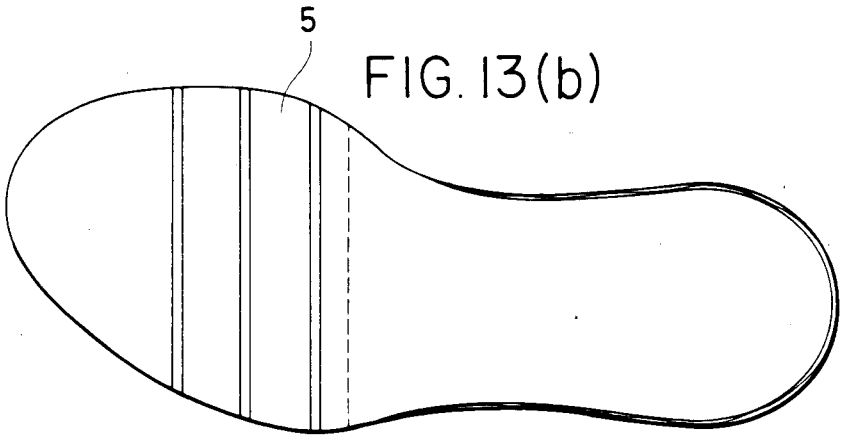
FIG. 13(c)
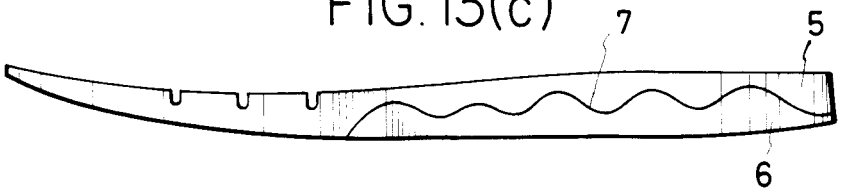
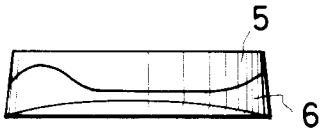
FIG. 13(d)

FIG. 14(a)
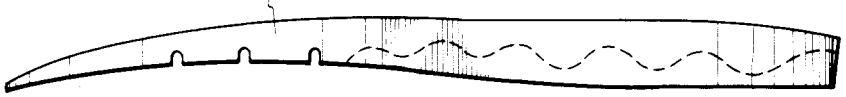
FIG. 14(b)
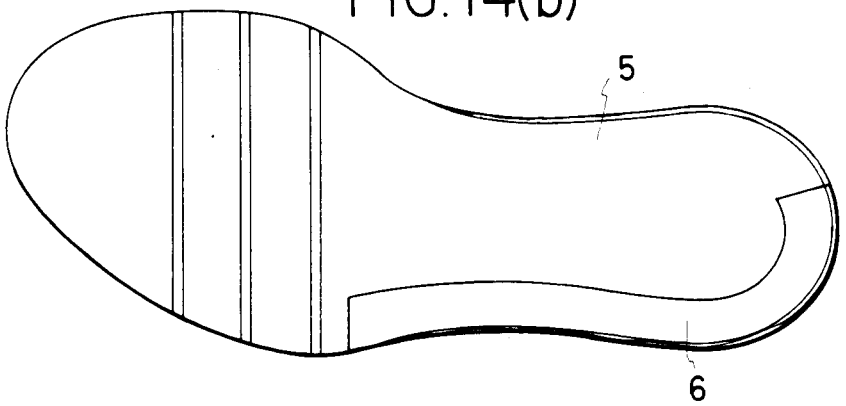
FIG. 14(c)
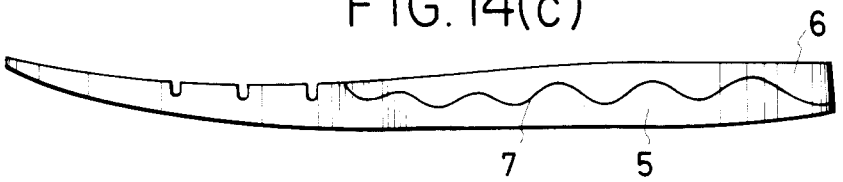
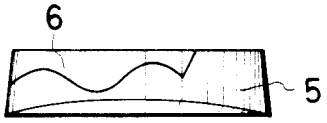
FIG. 14(d)

FIG. 15(a)
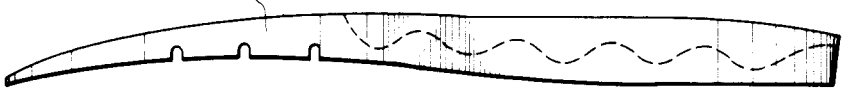
FIG. 15(b)
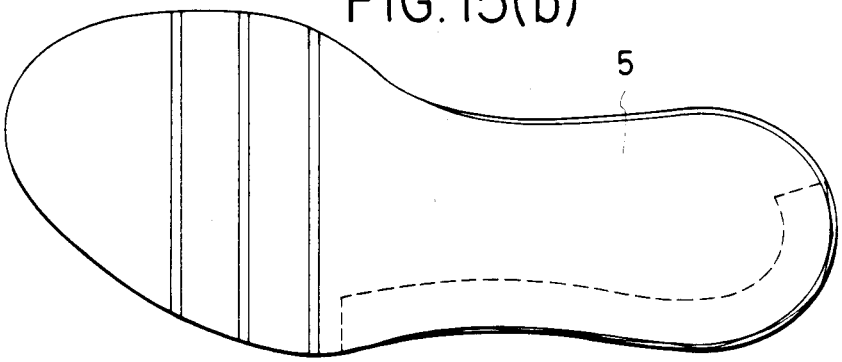
FIG. 15(c)
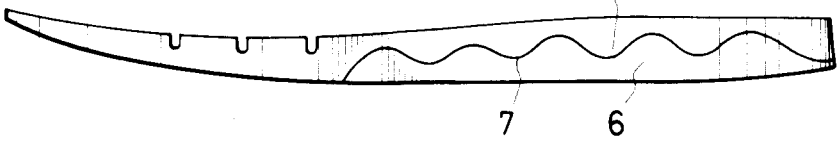
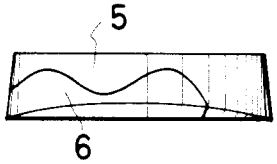
FIG. 15(d)

FIG. 16(a)
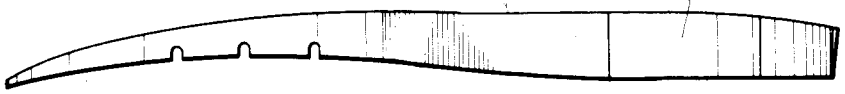
FIG. 16(b)
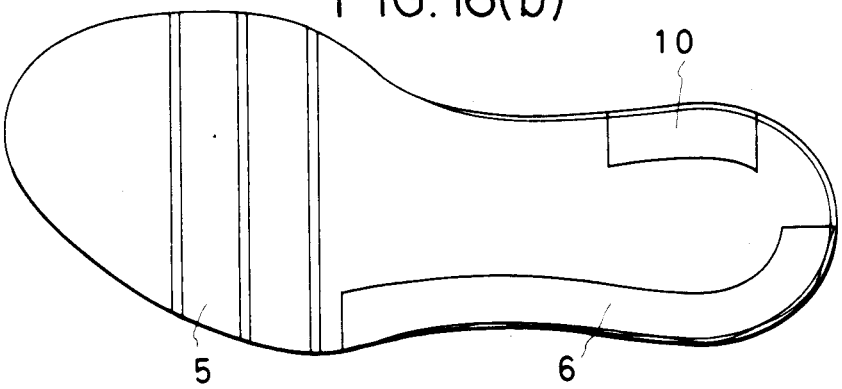
FIG. 16(c)
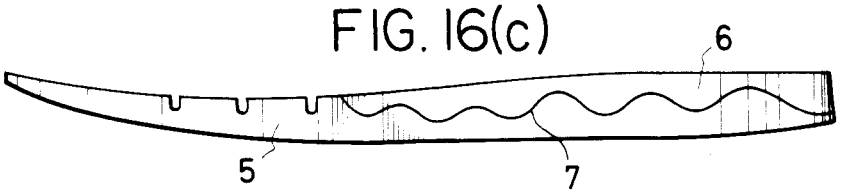
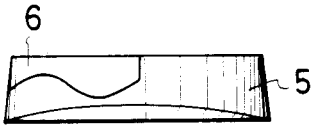
FIG. 16(d)

FIG. 17(a)
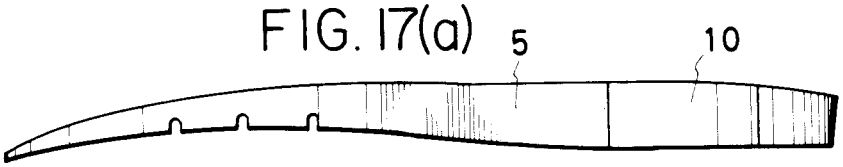
FIG. 17(b)
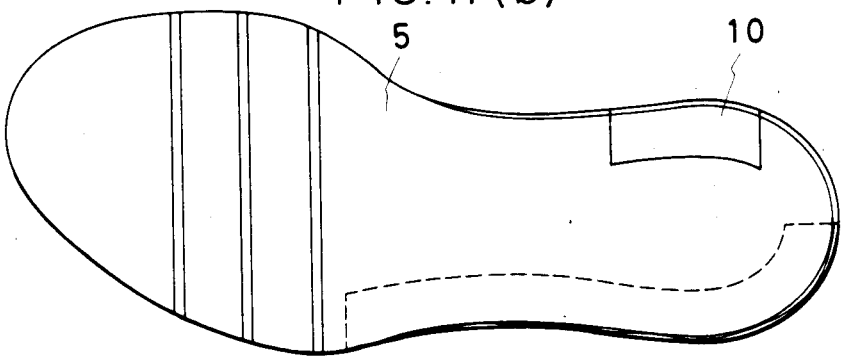
FIG. 17(c)
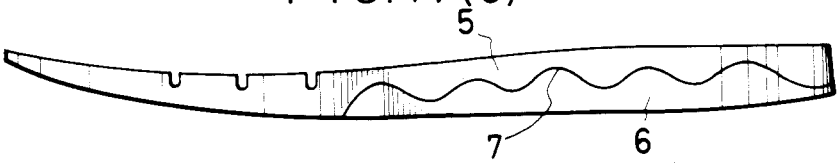
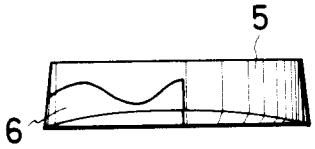
FIG. 17(d)

FIG. 18(a)
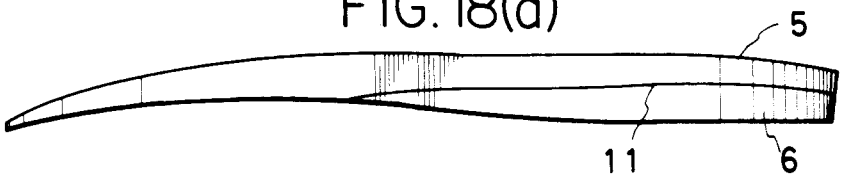
FIG. 18(b)
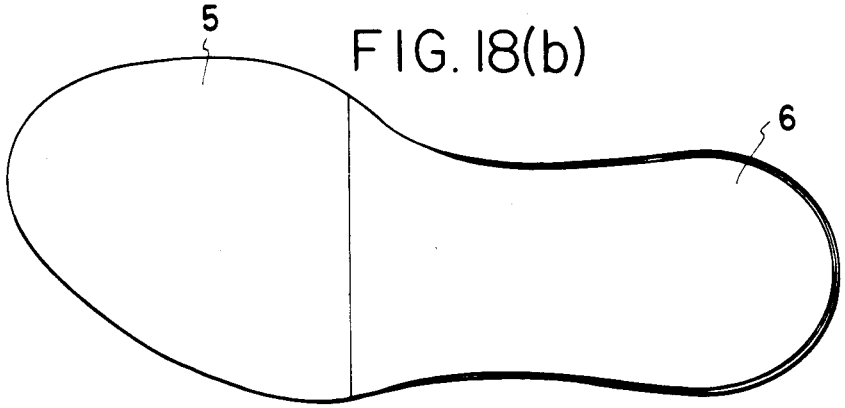
FIG. 18(c)
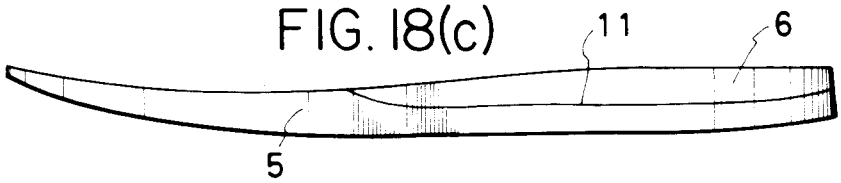
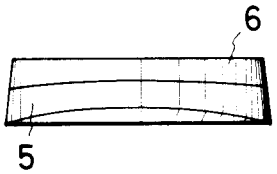
FIG. 18(d)

FIG. 19(a)
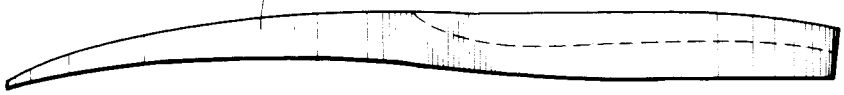
FIG. 19(b)
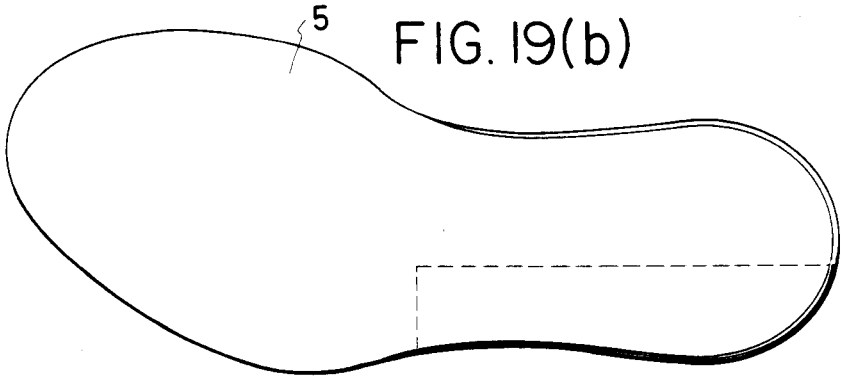
FIG. 19(c)
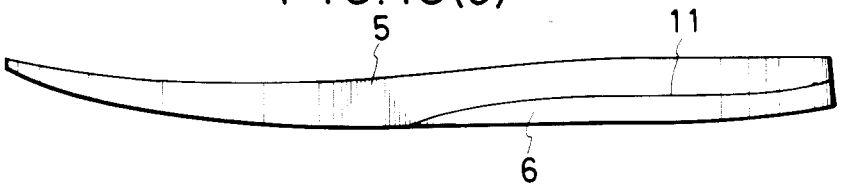
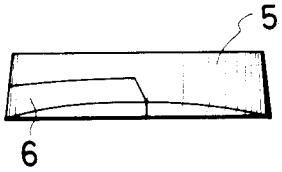
FIG. 19(d)

MIDSOLE FOR SPORTS SHOES

This is a continuation of co-pending application Ser. No. 913,568 filed on Sept. 29, 1986, which is continuation, of application Ser. No. 650,287, filed Sept. 12, 1984, both abandoned.

This invention relates to a midsole for sports shoes which comprises a soft elastic member and a hard elastic member, and more particularly the invention relates to such midsole having a specific structure for improving cushioning of the shoes.

Since jogging has become popular among people, greater interest has come to be shown in "running injuries". By the term "running injuries" are meant the troubles which occur in various parts of the runner's body during running or other physical exercises. The typical cases of such running injuries are trouble to the knee, peritendinitis of Achilles tendon, pain to the rear medial part in the one-third of the shinbone, plantar fasciitis and such. As the causes of these troubles, there are pointed out the structure of the sports shoes and an anatomical defect of the runner's legs. For instance, poor cushioning of the shoes gives a heavy impact to the feet of the shoe wearer and this tends to cause trouble to the knees. It is said that, during running, a force which is 2 to 3 times as large as the body weight in magnitude is given between the runner's foot and the ground surface, so that if the sports shoes are poor in cushioning, an excess force is repeatedly given to his feet. As this is continued for a long time, stress builds up in his joints and ligaments to cause a running injury.

Generally, during running, most people touch a heel of their feet on the ground at first. In the case of ordinary runner who lands heel at first during running, his foot slightly takes the position of supination at the moment of landing. This is a natural result of foot movement as the runner lifts up his feet forwards toward the center line in the running direction. The force which is transferred from the ground surface to the foot is, in most cases, maximized when the whole sole is landed on the ground and the centroid of the body comes just above the foot. However, the impact exerted to the knee becomes maximal immediately after landing of the heel. Therefore, the cushioning property of the heel portions of sports shoes are an important matter of consideration.

The object of this invention is to provide a midsole for sports shoes, which comprises a hard elastic member and a soft elastic member which has a lower hardness than that of said hard elastic member, one surface of said hard elastic member being joined to one surface of said soft elastic member which is opposite to said one surface of said hard elastic member, said one surface of said hard elastic member having a wavy configuration at the outer area of the heel portion thereof with respect to a longitudinal direction of said midsole, said one surface of said soft member having a complementary configuration to said one surface of said hard elastic member at the outer area of the heel portion thereof.

FIG. 4 (*a*), (*b*), (*c*) and (*d*) through FIG. 17 (*a*), (*b*), (*c*) and (*d*) show the side views, top plan views, side views and rear views (of the heel portion), respectively, of the midsoles according to this invention.

FIGS. 18 and 19 (*a*), (*b*), (*c*) and (*d*) show said views of the conventional midsoles.

Figure 20A:
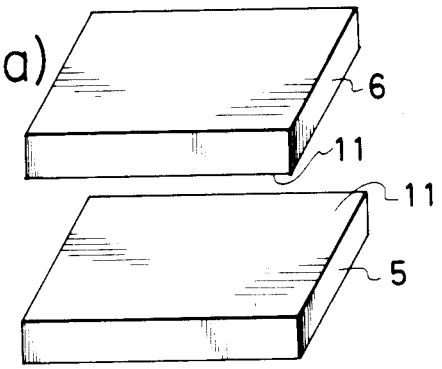
Figure 20B:
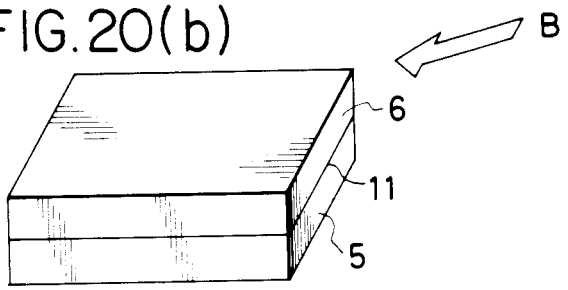

FIG. 20 (*a*) and (*b*) are the drawings for illustrating the flat joint in a conventional midsole.

Figure 21A:
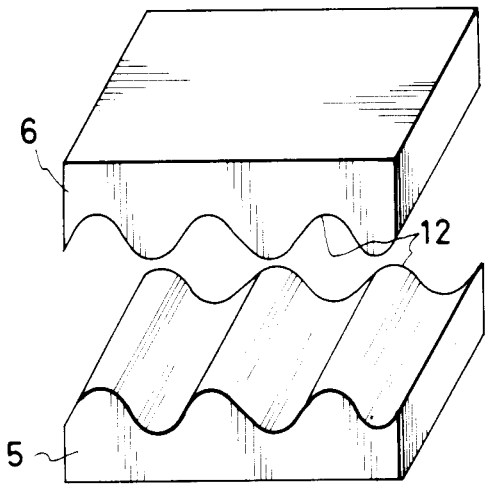
Figure 21B:
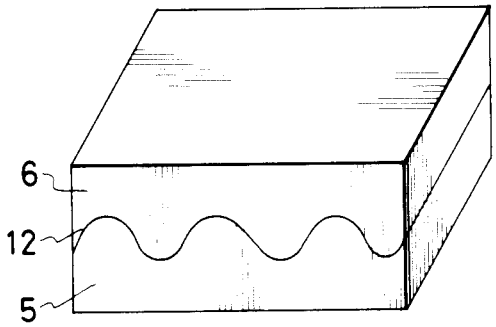
Figure 22:
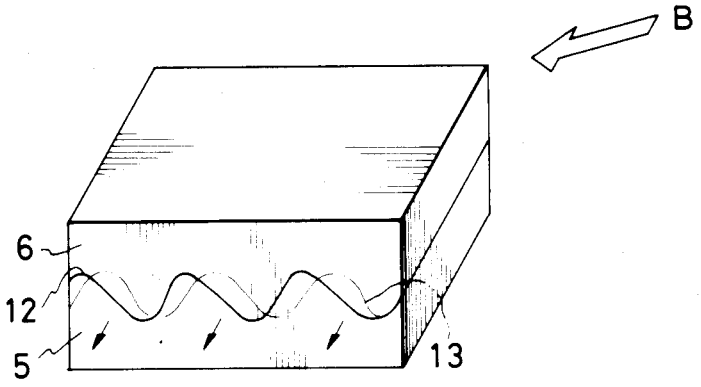

FIG. 21 (*a*) and (*b*) and FIG. 22 are the drawings for illustrating the waved joint and shearing strain in the midsole according to this invention.

Heretofore, midsoles having a structure made by bonding two elastic members different in hardness have been developed for improving cushioning of the heel portion of the midsole. Typical examples of such midsoles are illustrated in FIGS. 18 and 19 (*a*), (*b*) and (*c*) where the midsole has a structure made by bonding a soft elastic member 5 and a hard elastic member 6. In such conventional midsoles, however, since the soft and hard elastic members 5 and 6 are joined to form a flat joint surface 11 as illustrated in FIG. 18 (*a*), FIG. 18 (*c*), FIG. 19 (*c*), FIG. 20 (*a*) and FIG. 20 (*b*), the joint tends to be influenced by the hardness of the adhesive used for bonding said members. Therefore, in case where an impact is exerted in the direction B in FIG. 20 (*b*), there hardly takes place a shearing strain, and thus no sufficient cushion is provided against the impact to the heel portion in the horizontal or oblique direction which impact is produced at the moment of each landing of the foot during running.

The present inventor has made more extensive studies for eliminating these problems of the conventional types of midsole for sports shoes and, as a result, could achieve the present invention.

The midsole for sports shoes according to this invention comprises a soft elastic member 5 and a hard elastic member 6 which are joined so that a part or whole of the joint surface 7 has a wavy or undulate configuration 12 in the longitudinal direction of the midsole as shown in FIG. 21 (*a*) and (*b*), so that when an impact is given in the direction B, a shearing strain is produced at the joint and/or at the neighborhood of the joint. The wavy configuration having at least two cycles of waves between a fore end of the heel portion and an aft end of the heel portion, the cycles of the waves having the same wavelength and the same amplitude. An adverse influence of the hardness of the adhesive is suppressed by the wavy configuration, and as a result, there takes place a phenomenon that the hard elastic member 6 is effectively forced into the soft elastic member 5 as shown in FIG. 22. Thus, the midsole of this invention has an excellent cushioning property especially against an impact in the horizontal or oblique direction, and hence it is suited not only as a midsole for jogging shoes but also as a midsole to be used for various types of sports shoes such as basketball shoes.

The shearing strain according to this invention is described in detail, while referring to the accompanying drawings. In the case where an impact in the horizontal or oblique direction B in FIG. 22 is applied to the laminate of a soft elastic member 5 and a hard elastic member 6 as shown in FIG. 22, the shearing strain is easily produced at the joint 12 and/or in the neighborhood of the joint 12, while the hard elastic member 6 is moved in the direction B on the condition that the bottom surface of the soft elastic member 5 is not moved. Concretely, in the case where the sports shoes provided with a midsole of this invention are worn by the shoe wearer, the feet (shoes) stop or stand more gently than that of the conventional shoes at the time of landing on the ground, while the shearing strain is produced in the midsole without sudden stopping or standing of the feet (shoes). Accordingly, the sports shoes provided with the midsole of this invention can mollify and reduce a strong reaction force from the ground so that a fatigue or a running injury to the feet of the shoe wearer is prevented by the preferable shearing strain of the midsole of this invention.

When the movement of the moving feet is stopped at the time of landing on the ground, a reaction force is applied to the feet from the ground. The reaction force is equivalent to a impulse corresponding to momentum of the feet in the direction of the ground. In general, the reaction force corresponds to about 3 to 5 times as the body weight of the shoe wearer in magnitude.

The magnitude of the impulse at the time of landing on the ground is calculated by the following formula.

$$\text{Impulse} = \text{Force} \times \text{Time}$$

The impulse at the time of landing on the ground is equivalent to the momentum just before landing. The momentum is not affected by the structure of the sports shoes and therefore, if the moving condition is identical, the momentum is a constant magnitude. In the case of a constant momentum, the force is in inverse proportion to the time. Accordingly, as the time required to stop the feet grows longer, the force on the feet is smaller.

For instance, if the amount of the required time between landing and completely stopping is prolonged into 10 times (for example, the time of 0.001 second is prolonged into 0.01 second), the force from the ground is naturally decreased into one-tenth.

In the case where sports shoes provided with the midsole of this invention are worn by a shoe wearer, the feet of the shoe wearer stop or stand gradually at the time of landing on the ground while the sole of the sports shoes produces a shearing strain and as a result, a reaction force from the ground is decreased by the shearing strain as mentioned above and the decrease in the reaction force produces the prevention of fatigue and running injury to the feet of the shoe wearer.

The present invention will be described in more detail hereinbelow by way of some preferred embodiments thereof with reference to the accompanying drawings.

Figure 1:
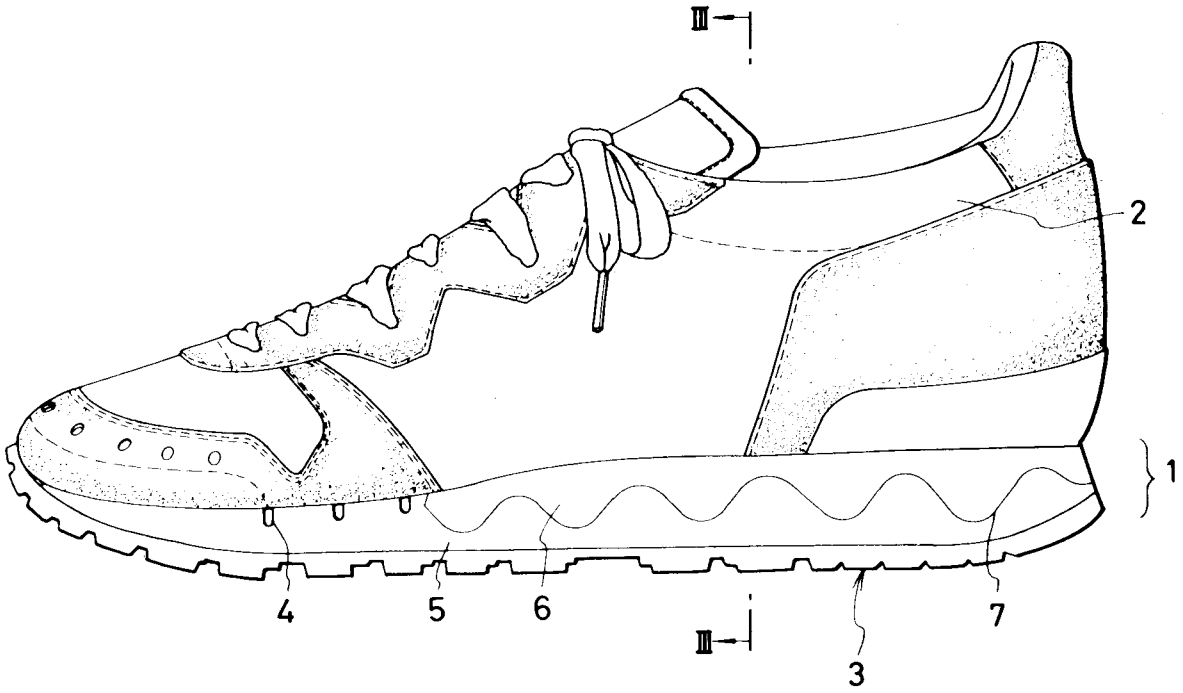
FIG. 1 is an external side view of a sports shoe (for left foot) having the midsole according to this invention.
Figure 2:
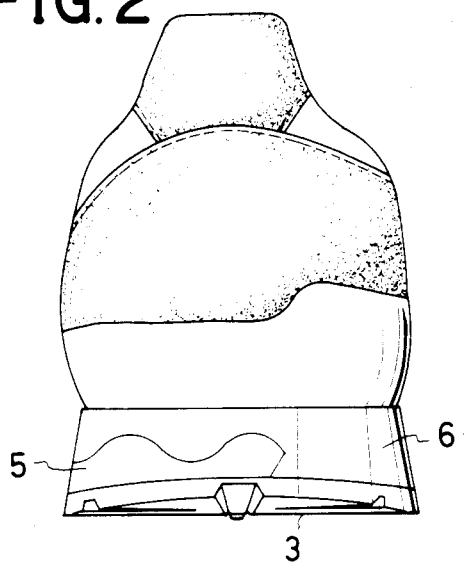
FIG. 2 is a rear side view of the heel portion of the shoe of FIG. 1.
Figure 3:
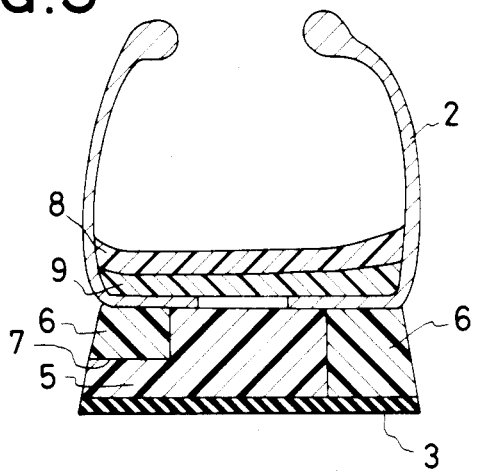
FIG. 3 is a sectional view taken along the line III—III of FIG. 1.
Figure 4A:
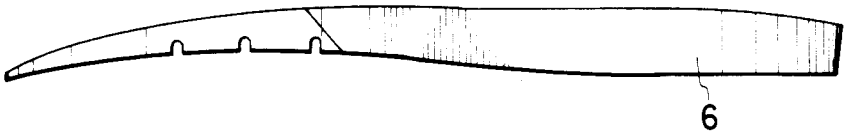
Figure 4B:
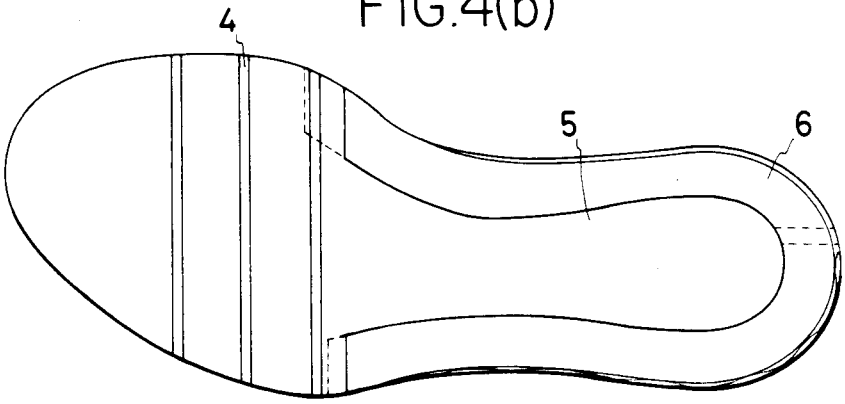
Figure 4C:
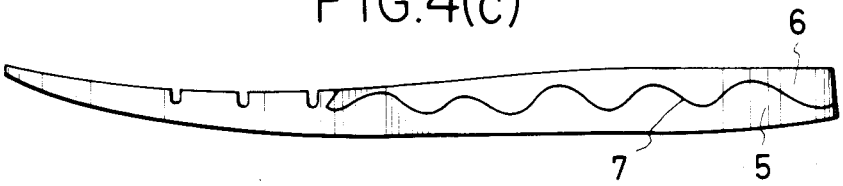
Figure 4D:
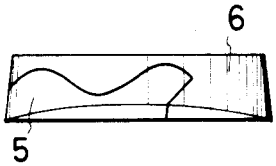
Figure 5A:
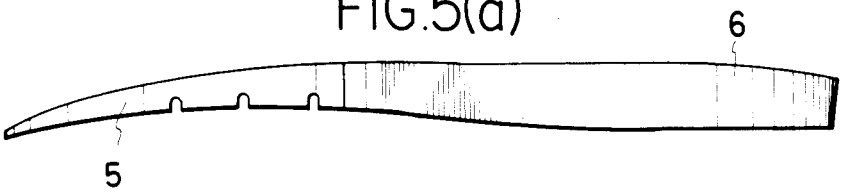
Figure 5B:
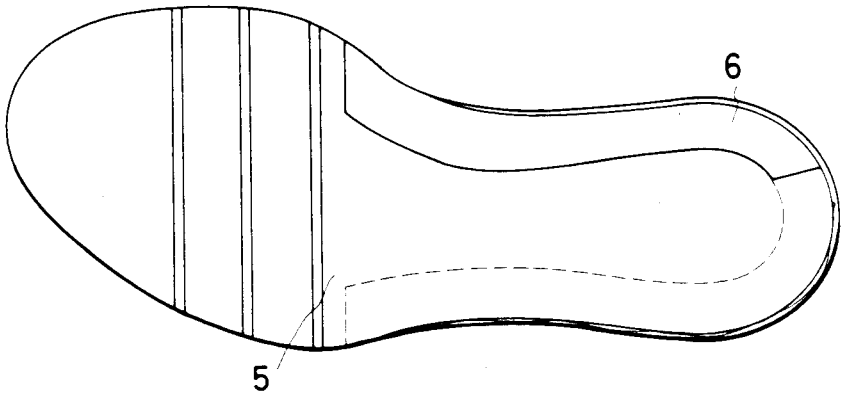
Figure 5C:
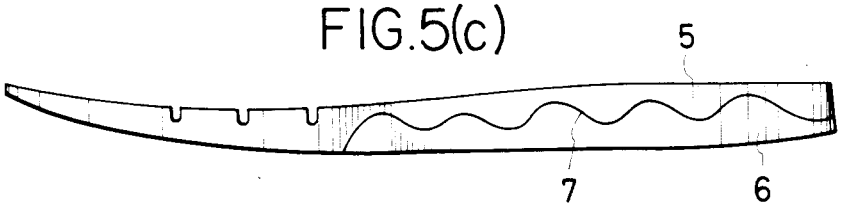
Figure 5D:
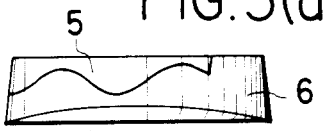
Figure 6A:
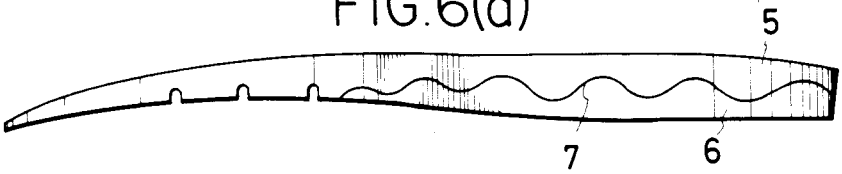
Figure 6B:
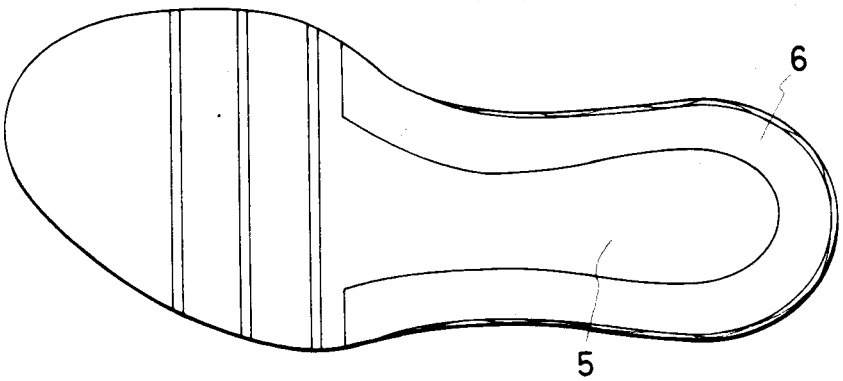
Figure 6C:
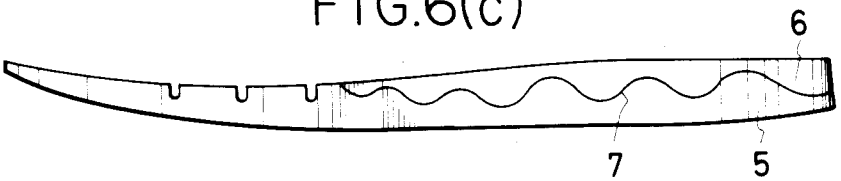
Figure 6D:
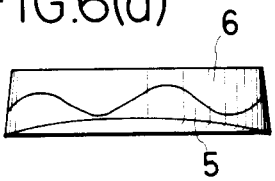
Figure 7A:
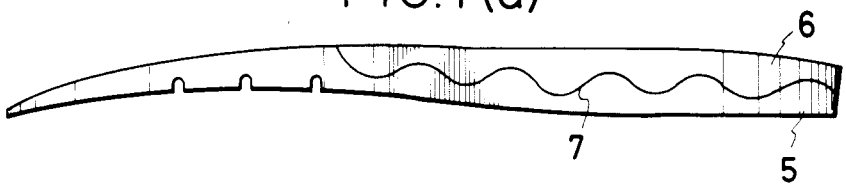
Figure 7B:
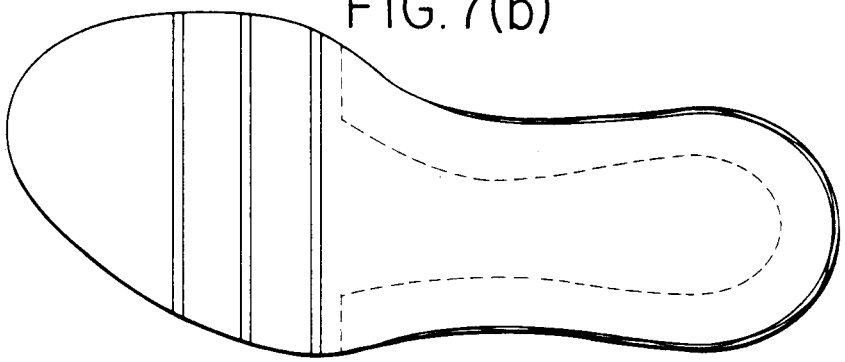
Figure 7C:
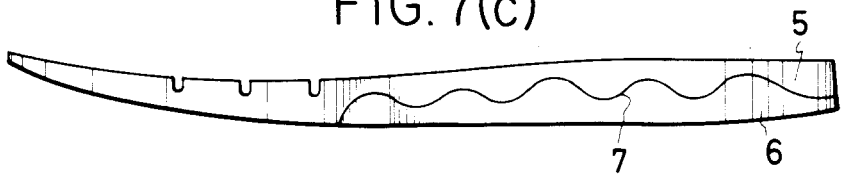
Figure 7D:
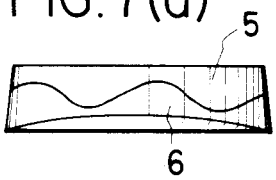
Figure 8A:
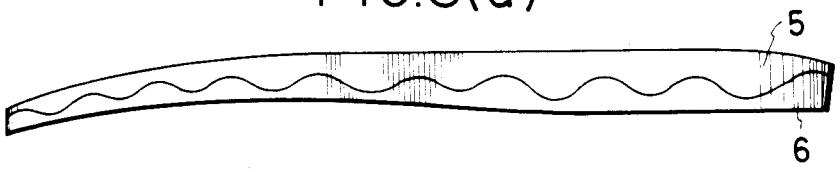
Figure 8B:
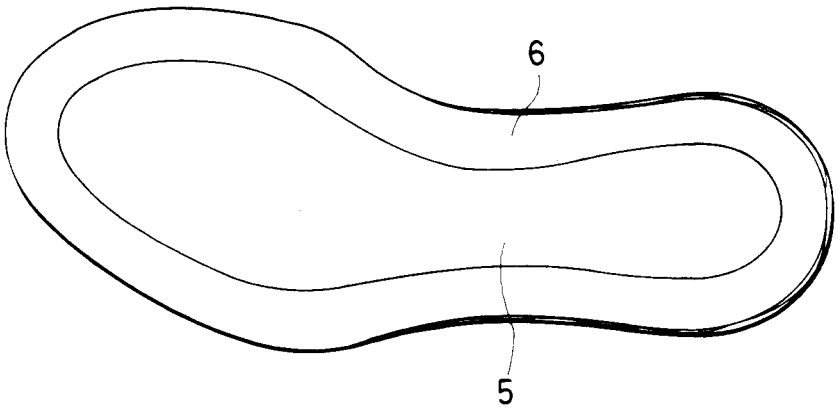
Figure 8C:
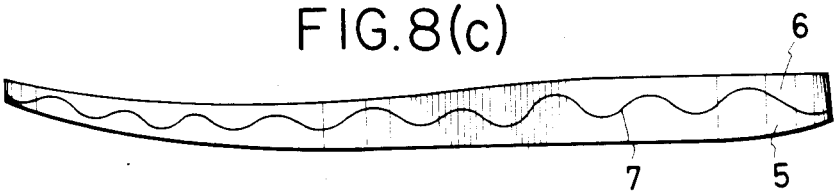
Figure 8D:
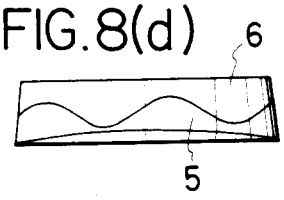

FIGS. 1 to 3 show an external side view, a rear view and a sectional view taken along the line III—III of FIG. 1, respectively, of a sports shoe (for left foot) provided with one of preferable embodiments of midsole of this invention. The midsole 1 comprises a soft elastic member 5 and a hard elastic member 6, and it is joined on its upper side to a shoe upper 2 and is joined on its underside to an outsole 3.

The outsole 3 is provided for improving the durability and the friction properties of the sole, and for this purpose, it is made of natural rubber, synthetic rubber, polyurethane or plastic material having excellent wear resistance. Usually, an elastomer such as styrene-butadiene rubber or its foamed body is used.

The midsole 1 gives a direct influence to the shoe wearer's foot motion, so that there are required for such midsole not only a good cushioning property but also a material and a shape which won't impair the flexibility of the fore foot portion. As the material to be used as the soft elastic member 5 of the midsole 1, in the case of a foamed type material, it is recommended to use an elastomer having a hardness of 30 to 50 as measured by a C-type hardness tester mentioned below, and in the case of a non-foamed type material, it is advised to use an elastomer having a hardness of 30 to 50 as measured by an A-type hardness tester mentioned below. Sports shoes are required to be light in weight and to have good cushioning, so that a foamed material, usually an ethylene-vinyl acetate copolymer foamed material is preferably used as the soft elastic member 5. The hardness of such foamed material is measured by using, for instance, an SRIS-0101 C type hardness tester.

As for the material to be used for the hard elastic member 6 of the midsole 1, it is necessary to use a material having a higher hardness than the soft elastic member 5. Examples of such material are natural rubber and elastomers such as styrene-butadiene rubber, butadiene rubber, isoprene rubber, acrylonitrile-butadien rubber, polyurethane, high-styreneresin, etc., or their mixtures. These materials are required to have a hardness not smaller than 60, preferably 60 to 80 (as measured by said C-type hardness tester in the case of foamed material or as measured by an A-type hardness tester mentioned below in the case of non-foamed material). In case the material used as the hard elastic member 6 is foamed, its hardness is measured in the same as in the case of said soft elastic member 5, and in case the hard elastic member 6 is made of a non-foamed material, its hardness is measured by using, for example, a JIS A-type hardness tester according to the method of JIS-K 6031. The most preferred material for use as the hard elastic member 6 is a blend of natural rubber and styrene-butadiene rubber or an elastomer such as ethylene-vinyl acetate, having a hardness of 60 to 80. It is also desirable that the difference in hardness between the soft elastic member 5 and the hard elastic member 6 is within the range of 10 to 40. Said soft elastic member 5 and hard elastic member 6 are joined at each tangential surface thereof. Such joining is usually made by applying an adhesive. A neoprene adhesive is usually used therefor. In the midsole of this invention, one of the surfaces of said both members 5 and 6 is so designed as to form a wavy configuration 12 as shown in FIG. 21 (*a*) at least at the section positioned along the outer area of the heel portion. Therefore, in case an impact of a horizontal or oblique direction is given to the shoe, the soft elastic member 5 is easily subjected to a shearing strain even at the area near the joint, and such strain mitigates the shock. Thus, the impact that tends to be produced at the outer edge area of the heel portion at the time of every landing of the runner's foot during running can be mollified more than in the conventional midsoles such as shown in FIGS. 18 and 19. In the conventional midsoles, the joint 11 between the soft and hard elastic members is flat, so that the soft elastic member is resistant to a shearing strain at the area near the joint and the hardness of adhesive is effected to the shearing strain and, therefore, the impact to the shoe in the horizontal or oblique direction can not be sufficiently mollified.

In the midsole of this invention, flex holes 4 may be provided in the fore foot portion for improving the flexibility of the midsole.

FIG. 4 (*a*), (*b*), (*c*) and (*d*) show the midsole used in the sports shoes shown in FIGS. 1 to 3. The joint 7 along the outer or lateral edge area of the heel portion is undulated for alleviating the horizontal or oblique impact produced in said lateral edge area of the heel portion at the time of landing of the runner's foot during running, and the inner or medial edge area of the heel portion is formed from the hard elastic member 6 for preventing the over-pronation of the runner's foot during running.

The wavy configuration of the hard elastic member 6 and the soft elastic member 5 at the joint 7 may be modified into a wavy, fan-like configuration.

FIG. 5 (*a*), (*b*), (*c*) and (*d*) show a midsole (for left foot) of this invention which is different from the midsole of FIG. 4 only in that the hard elastic member 6 is provided on the ground-contacting side at the lateral edge area of the heel portion.

FIG. 6 (*a*), (*b*), (*c*) and (*d*) show a midsole (for left foot) of this invention in which the hard elastic member 6 is provided on the foot-contacting side at the edge area of the heel portion and the joint 7 between the soft and hard elastic members 5 and 6 is entirely undulated.

The midsole (for left foot) of this invention shown in FIG. 7 (*a*), (*b*), (*c*) and (*d*) is different from the midsole of FIG. 6 only in that the hard elastic member 6 is provided on the ground-contacting side.

In the midsole (for left foot) of this invention shown in FIG. 8 (*a*), (*b*), (*c*) and (*d*), the hard elastic member 6 is provided along the entire lateral edge area on the foot contacting side of the midsole and the joint 7 between the soft and hard elastic members 5 and 6 is undulated in its entirely.

FIG. 9 (*a*), (*b*), (*c*) and (*d*) show a midsole (for left foot) of this invention which is different from the midsole of FIG. 8 only in that the hard elastic member 6 is provided on the ground-contacting side.

In another midsole (for left foot) of this invention shown in FIG. 10 (*a*), (*b*), (*c*) and (*d*), the hard elastic member 6 is provided over the entirety of the foot-contacting side of the midsole and the joint 7 between the soft and hard elastic members 5 and 6 is wholly undulated.

The midsole (for left foot) of this invention shown in FIG. 11 (*a*), (*b*), (*c*) and (*d*) is different from that of FIG. 10 only in that the hard elastic member 6 is provided on the ground-contacting side. The midsoles of FIGS. 10 and 11 are especially excellent in their effect of mitigating the impact force produced in the horizontal direction at the time of sudden deceleration or stoppage of the shoe wearer's motion, so that they are suited for basketball shoes.

In the midsole of this invention shown in FIG. 12 (*a*), (*b*), (*c*) and (*d*), the hard elastic member 6 is provided over the entirety of the foot-contacting side of the plantar arch portion and the heel portion and the joint 7 between the soft and hard elastic members 5 and 6 is wavy in a longitudinal direction.

The midsole (for left foot) of this invention shown in FIG. 13 (*a*), (*b*), (*c*) and (*d*) is different from the midsole of FIG. 12 only in that the hard elastic member 6 is provided on the ground-contacting side.

FIG. 14 (*a*), (*b*), (*c*) and (*d*) show a midsole (for left foot) of this invention in which the hard elastic member 6 is provided on the foot-contacting side of the lateral edge area of the heel portion and the joint 7 between the soft and hard elastic members 5 and 6 is undulated.

The midsole (for left foot) of this invention shown in FIG. 15 (*a*), (*b*), (*c*) and (*d*) is different from the midsole of FIG. 14 only in that the hard elastic member 6 is provided on the ground-contacting side.

The midsoles (for left foot) of this invention shown in FIG. 16 (*a*), (*b*), (*c*) and (*d*) and FIG. 17 (*a*), (*b*), (*c*) and (*d*) are same as the midsoles of FIG. 14 and FIG. 15, respectively, except that a stabilizing pillar 10 made from the hard elastic member is provided at the medial edge area of the heel portion for preventing the over-pronation of the wearer's foot.

As described above, the midsoles for sports shoes according to this invention have the excellent cushioning property against the impact in the horizontal or oblique direction. It will be obvious that the scope of this invention is not limited to the foregoing embodiments but embraces other changes and modifications that can be made without departing from the spirit and principle of this invention.

What is claimed is:

1. A sports shoe comprising:

(a) a shoe upper;

(b) an outsole; and (c) a midsole comprising a soft elastic member and a hard elastic member having a greater hardness than that of the soft elastic member, the hard elastic member being disposed at one of a foot-contacting side of the midsole and a ground-contacting side of the midsole in a portion of at least lateral edge area of a heel portion of the midsole, the soft elastic member having an upper surface to which said shoe upper is joined, a lower surface to which said outsole is joined, and a joint surface joined to a joint surface of the hard elastic member and extending between the upper surface and the lower surface so as to face to one of the upper surface and the lower surface, the joint surface of the soft elastic member and the joint surface of the hard elastic member each having a complementary wavy configuration along a direction of longitudinal center axis line of the shoe for mollifying and reducing a strong reaction force produced by an impact to the shoe in a horizontal or oblique direction, the wavy configuration having at least two cycles of waves between a fore end of the heel portion and an aft end of the heel portion, the cycles of the waves having substantially the same wavelength and substantially the same amplitude.

2. The sports shoe according to claim 1, in which the soft elastic member has a hardness of 30 to 50 shore durometer, the hard elastic member has a hardness of 60 to 80 shore durometer, and the difference in hardness between the soft elastic member and the hard elastic member is 10 to 40 shore durometer.

3. The sports shoe according to claim 1, in which the hard elastic member is disposed at the foot-contacting side of the midsole.

4. The sports shoe according to claim 1, in which the hard elastic member is disposed at the ground-contacting side of the midsole.

5. The sports shoe according to claim 3 or 4, in which the hard elastic member is disposed at lateral edge area of a plantar arch portion of the midsole, the hard elastic member further occupying from a fore end of the heel portion to the fore end of the plantar arch portion.

6. The sports shoe according to claim 5, in which a pillar is further disposed at medial edge area of the heel portion of the midsole, said pillar having the same hardness and elasticity as the hard elastic member.

7. The sports shoe according to claim 3 or 4 in which the hard elastic member is further disposed at a medial edge area of the heel portion of the midsole.

8. The sports shoe according to claim 7, in which the hard elastic member is further disposed at a medial edge area of a plantar arch portion of the midsole.

9. The sports shoe according to claim 3 or 4, in which the hard elastic member is further disposed over at least the entirety of the heel portion of the midsole.

10. The sports shoe according to claim 5, in which a plurality of flex holes are formed on the foot-contacting side of a fore foot portion of the midsole in a direction perpendicular to the longitudinal center axis line.

* * * * *